United States Patent [19]

Walden et al.

[11] 4,317,337

[45] Mar. 2, 1982

[54] CLASP FOR GLOWING LIQUID FILLED TUBULAR JEWELRY

[76] Inventors: Judith Walden, 2577 ½ Beachwood Dr., Hollywood, Calif. 90068; Dominic Sicilia, 569 N. Rossmore, Los Angeles, Calif. 90004

[21] Appl. No.: 756,577

[22] Filed: Jan. 3, 1977

[51] Int. Cl.[3] ..... A44C 5/00

[52] U.S. Cl. ..... 63/3; 24/129 D; 273/DIG. 24; 428/35; 403/305

[58] Field of Search ..... 240/2.25; 252/188.3 CL; 273/DIG. 24; 24/129 D; 156/67; 428/35, 913; 403/300, 305, 308; 63/1, 2, 3

[56] References Cited

U.S. PATENT DOCUMENTS 1,455,993 5/1923 Conway ..... 403/308 X 2,413,984 1/1947 Mackall ..... 24/129 D

*Primary Examiner*—F. Barry Shay

*Attorney, Agent, or Firm*—Harry E. Aine

[57] ABSTRACT

The internally plugged ends of glowing liquid filled tubular jewelry are releasably clasped together for making necklaces, joining adjacent tubular sections together and the like, by means of a flexible plastic tubular clasp member, as of clear polyvinylchloride, into which the internally plugged ends of glowing liquid filled tubular jewelry are fitted snugly. The tubular clasp member is axially coextensive with the plugged end portions of the liquid filled tubular jewelry so that the inner wall of the tubular clasp member frictionally grips the outside wall of the tubular member of the jewelry.

2 Claims, 2 Drawing Figures

CLASP FOR GLOWING LIQUID FILLED TUBULAR JEWELRY

BACKGROUND OF THE INVENTION

The present invention relates in general to glowing liquid filled tubular jewelry and more particularly to an improved clasp for joining internally plugged ends of such jewelry together.

DESCRIPTION OF THE PRIOR ART

Heretofore, the internally plugged ends of glowing liquid filled tubular jewelry have been joined together by means of a tubular clasp member into which the outwardly extending tip portions of the plugs are inserted for joining two end portions of the jewelry together.

We have discovered that the problem with the prior art clasp was that the plugs, typically 1/16 inch diameter plastic, become brittle and break off in the region between the clasp and the adjacent plugged end of the tubular jewelry or pull from the ends of the tubular jewelry causing leaks. Therefore, it is desirable to provide a releasable clasp for glowing liquid filled tubular jewelry which will avoid the failures previously encountered with the aforementioned prior art clasp.

SUMMARY OF THE PRESENT INVENTION

The principal object of the present invention is the provision of an improved clasp for glowing liquid filled tubular jewelry and, more particularly, to such a clasp which will permit the ends of the jewelry to be releasably clasped together in a simple manner without experiencing breakage or leakage of the tubular jewelry.

In one feature of the present invention, the clasp includes a flexible plastic tubular member to which the internally plugged ends of glowing liquid filled tubular jewelry are snugly inserted in such a manner that the plugged end portion of the tubular jewelry is axially coextensive with a portion of the tubular clasp member, the clasp member frictionally gripping the outside wall of the plugged tubular member of the jewelry.

Other features and advantages of the present invention will become apparent upon a perusal of the following specification taken in connection with the accompanying drawings wherein:

DESCRIPTION OF THE PREFERRED EMBODIMENTS

Figure 1:
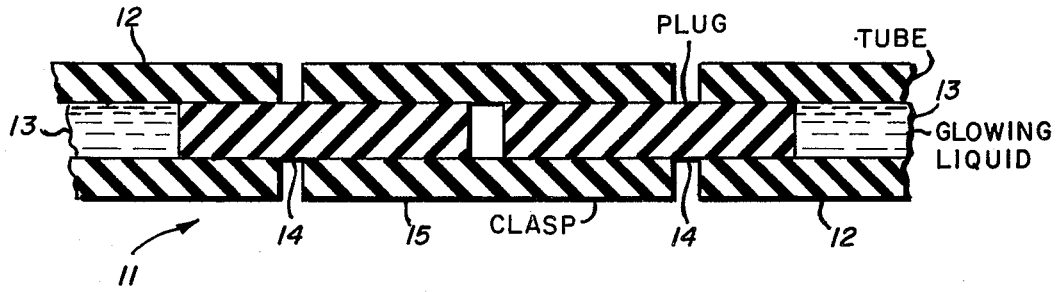
Fig 1 PRIOR ART
FIG. 1 is a longitudinal sectional view of a prior art clasp for releasably clasping together the plugged ends of glowing liquid filled tubular jewelry.

Referring now to FIG. 1 there is shown the prior art clasp structure 11 for releasably clasping together the internally plugged ends of glowing liquid filled tubular jewelry. More particularly, the tubular jewelry includes one or more lengths of flexible clear tubular plastic 12, as of ⅛ inch OD-1/16 inch ID clear polyvinylchloride, filled with a glowing liquid 13. Such a glowing liquid is commercially available from American Cyanamide Co., Organic Chemical Divisions, Bound Brook, N.J., as Cyalume light stick and manufactured under one or more of U.S. Pat. Nos. 3,597,362 and 3,576,987. The glowing liquid 13 otherwise known as chemiluminescent liquid comprises two components which are mixed together and which after mixing emit a green neon tube-like glowing light for a number of hours due to a chemical reaction of the two components of the liquid mixture.

After the tube 12 is filled with the glowing liquid, the ends thereof are plugged by means of a solid plastic rod 14. A length of each of the plugs 14 is left protruding from the internally plugged ends of the glowing liquid filled tubes 12. Adjacent ends of such tubular sections or the opposite ends of one such tubular section are joined together by means of a releasable clasp 15 to form bracelets, necklaces, etc. The clasp 15 includes a tubular flexible plastic member, as of clear polyvinylchloride, of the same material as tubing 12 into which the protruding plug portions are inserted. The clasp 15 frictionally grips the ends of the plugs 14 for providing a releasable clasping action.

The problem with this prior art clasp 15 is that the plugs 14 are relatively brittle and we have found that the plugs 14 tend to break off in the regions between the ends of the clasp 15 and the adjacent end of the tubes 12 and to pull from the ends of the tubing 12 as to break the seal between the plug 14 and the tube 12 for release of liquid.

In the manufacturing process for making the glowing liquid filled tubular jewelry, the jewelry is manufactured and then stored for weeks by refrigerating the liquid filled jewelry to dry ice temperatures. However, this tends to embrittle the plugs 14, thereby further aggravating the breakage problems encountered with the prior art clasp.

Figure 2:
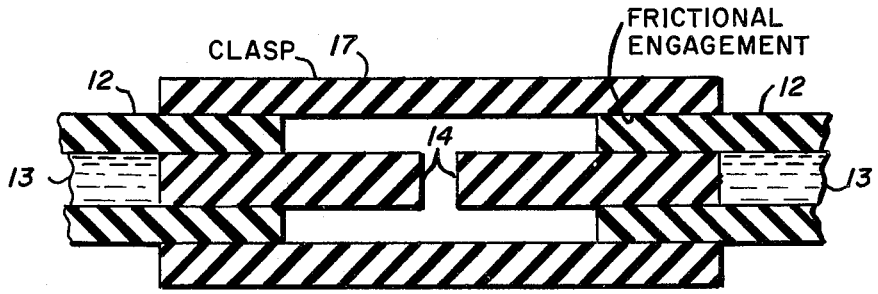
FIG. 2 is a view similar to that of FIG. 1 depicting the clasp of the present invention.

Referring now to FIG. 2, there is shown the releasable clasp 17 of the present invention. In the clasp of FIG. 2, the tubular clasp member 17 has an inside diameter closely approximating the outside diameter of the tubular members 12 to be joined. In a typical example the tubular clasp has an inside diameter of ⅛ inch and an outside diameter of ¼ inch. Instead of the tubular clasp member 17 snugly gripping the protruding ends of the plugs 14, the clasp member 17 snugly grips the outside wall of the internally plugged ends of the tubular portions 12 of the jewelry. In this manner the stress on the plug 14 is relieved in the clasping and unclasping process. Furthermore, the clasp 17 may be fastened and unfastened a number of times by merely inserting the plugged ends of the tubular member 12 into the clasp 17 and axially pulling them apart. In this process no forces are applied to the plugs 14 and therefore the seals made by the plugs 14 in the ends of the tubular jewelry sections 12 remain intact, thereby avoiding undesired leakage sometimes encountered when using the prior art clasp 15.

What is claimed is:

1. An article of chemiluminescent liquid filled tubular jewelry, said article having tubular end portions, chemiluminescent liquid filling the hollow portions of said tubular article of jewelry, means for sealing said liquid therein by sealing off said end portions of said tubular article, and a clasp comprising a flexible plastic member with an opening at each end, said openings being of a size and shape for snugly receiving therewithin said sealed off end portions of said tubular member and for maintaining them in clasped relation by frictional engagement therewith.

2. An article of chemiluminescent liquid filled tubular jewelry, said article having tubular end portions, chemiluminescent liquid filling the hollow portions of said tubular article, means for sealing said liquid therein including plugs received internally in said end portions and a clasp comprising a flexible plastic tubular member with an opening at each end, said openings being of a size and shape for snugly receiving therewithin said internally plugged end portions and for maintaining them in clasped relation by frictional engagement.

* * * * *